US012799689B2

(12) United States Patent
Xu et al.

(10) Patent No.: US 12,799,689 B2
(45) Date of Patent: Nov. 17, 2026

(54) JOINTLESS BRIDGE EXPANSION AND CONTRACTION DEVICE

(71) Applicant: Ningbo Roaby Technology Industrial Group Co., Ltd., Ningbo (CN)

(72) Inventors: Su Xu, Ningbo (CN); Bin Xu, Ningbo (CN); Qi You, Ningbo (CN); Xueliang Hong, Ningbo (CN); Meijun Hao, Ningbo (CN)

(73) Assignee: Ningbo Roaby Technology Industrial Group Co., Ltd., Ningbo (CN)

( * ) Notice: Subject to any disclaimer, the term of this patent is extended or adjusted under 35 U.S.C. 154(b) by 281 days.

(21) Appl. No.: 18/843,493

(22) PCT Filed: Jan. 30, 2024

(86) PCT No.: PCT/CN2024/074616
§ 371 (c)(1),
(2) Date: Sep. 3, 2024

(87) PCT Pub. No.: WO2024/164881
PCT Pub. Date: Aug. 15, 2024

(65) Prior Publication Data

US 2025/0188690 A1 Jun. 12, 2025

(30) Foreign Application Priority Data

Feb. 9, 2023 (CN) ..... 202320277529.2

(51) Int. Cl.
*E01D 19/06* (2006.01)

(52) U.S. Cl.
CPC ..... *E01D 19/06* (2013.01)

(58) Field of Classification Search
CPC ..... E01D 19/06; E01D 19/065
See application file for complete search history.

(56) References Cited

U.S. PATENT DOCUMENTS 4,319,855 A * 3/1982 Huber ..... E01D 19/06 14/73.1
2022/0341106 A1* 10/2022 Park ..... E01D 19/06

FOREIGN PATENT DOCUMENTS

CN 104746425 A * 7/2015
CN 105803934 A * 7/2016 ..... E01D 19/065
CN 111519524 A * 8/2020 ..... E01D 19/06
CN 112195769 A * 1/2021 ..... E01D 19/125
CN 214939238 U * 11/2021

(Continued)

*Primary Examiner* — Abigail A Risic
(74) *Attorney, Agent, or Firm* — Wang Law Firm, Inc.

(57) ABSTRACT

A jointless bridge expansion and contraction device comprises supporting blocks, expansion and contraction members and spring draw rods. Each of an end of the first beam and an end of the second beam has a mounting recess to mount the supporting blocks. Each expansion and contraction member is disposed on the supporting blocks, a root end of each expansion and contraction member is connected to the end of the first beam or the end of the second beam. The spring draw rods is disposed on the supporting blocks, two ends of each spring draw rod are respectively connected to the end of the first beam and the end of the second beam. Each mounting recess is filled with an elastic filling layer. This device can satisfy the elasticity and deformation in longitudinal, transverse and vertical directions of curved, slope and skew bridges.

8 Claims, 5 Drawing Sheets

(56) References Cited

FOREIGN PATENT DOCUMENTS

| | | | | | |
|---|---|---|---|---|---|
| CN | 215561903 | U | * | 1/2022 | |
| CN | 114150574 | A | * | 3/2022 | ..... E01D 19/065 |
| CN | 217536654 | U | * | 10/2022 | |
| JP | H08134818 | A | * | 5/1996 | |
| KR | 20020088733 | A | * | 11/2002 | ..... E01C 11/02 |

* cited by examiner

JOINTLESS BRIDGE EXPANSION AND CONTRACTION DEVICE

TECHNICAL FIELD OF THE INVENTION

The present invention relates to a technical field of bridge expansion joints, and in particular to a jointless bridge expansion and contraction device.

BACKGROUND OF THE INVENTION

In order to deal with bridge beam deformation, bridge expansion and contraction devices are generally mounted between two beam ends of the bridge and between the beam end and the bridge abutment or at a binged position of the bridge. The existing bridge expansion and contraction devices mainly comprises comb plate type expansion and contraction joints and modular expansion and contraction joints, and the two types of expansion and contraction joints have been widely applied and developed at present. However, due to the structural defects, gaps occur between profile steel or teeth, resulting in jolts and bringing discomfort of driving. Moreover, in a bridge structure, expansion and contraction joints are important assemblies that reflect the structural displacement of a bridge. Once an expansion and contraction joint is displaced beyond the design allowable value, it indicates that important hidden dangers exist in the stability and safety of the structure. Particularly for skew bridges, due to the temperature, vehicle load, wind load and other factors, beams are easy to displace, thus affecting the safety of the bridge structure. Thus, various jointless bridge expansion and contraction devices have been disclosed in the prior art. In the conventional jointless expansion joints, a narrow bridge floor pavement layer is replaced with a high-elasticity special asphalt mixture, which is generally used on bridges with a design temperature joint of below 50 mm but is not suitable for large-traffic-flow bridges and long-span bridges.

SUMMARY OF THE INVENTION

It is an object of the present invention to provide a jointless bridge expansion and contraction device, which is simple in construction and suitable for bridges with large scale displacement and large traffic flow.

For achieving the above object, the bridge has a first beam and a second beam, the jointless bridge expansion and contraction device disposed between an end of the first beam and an end of the second beam comprises a plurality of supporting blocks each arranged widthwise of the bridge; a plurality of expansion and contraction members each having a root end; a plurality of spring draw rods each having two ends; wherein, each of the end of the first beam and the end of the second beam has a mounting recess to mount the plurality of supporting blocks; each expansion and contraction member is disposed on the plurality of supporting blocks and distributed at intervals along the width of the bridge, the root end of each expansion and contraction member is connected to the end of the first beam or the end of the second beam adjacent to the root end of the expansion and contraction member; the plurality of spring draw rods with two ends is disposed on the plurality of supporting blocks distributed at intervals along the width of the bridge, two ends of each spring draw rod are respectively connected to the end of the first beam and the end of the second beam; the mounting recess of each of the end of the first beam and the end of the second beam is filled with an elastic filling layer, and the plurality of supporting blocks, the plurality of expansion and contraction members and the plurality of spring draw rods are buried in the elastic filling layer.

In order to prevent the expansion and contraction device from being damaged, preferably, two anti-crash baffles located in the mounting recess are respectively connected to the end of the first beam and the end of the second beam; the two ends of each spring draw rod are connected to the anti-crash baffle on the corresponding mounting recess, the root end of each expansion and contraction member is connected to the anti-crash baffle on the corresponding mounting recess.

In order to improve a driving stability, a top surface of the elastic filling layer is flush with a top surface of the anti-crash baffles.

Preferably, a bridge floor pavement layer is paved on the mounting recess at a side of each anti-crash baffle away from the plurality of expansion and contraction members and a top surface of each bridge floor pavement layer is flush with the top surface of each anti-crash baffle.

The supporting blocks may use various ways for fixation. Preferably, a pre-buried steel plate is mounted beneath each mounting recess, the plurality of supporting blocks is connected to the pre-buried steel plate.

In order to make a distribution of the expansion and contraction members and the spring draw rods more reasonable, the plurality of expansion and contraction members and the plurality of spring draw rods are distributed alternatively and at regular intervals along the width of the bridge.

In order to limit the expansion and contraction members so as to ensure a sliding direction of the expansion and contraction members, each supporting block has a plurality of guide grooves at a top of each supporting block, each expansion and contraction member is positioned inside the corresponding guide groove.

In order to avoid a leakage of elastic materials during pouring, a filler is mounted in a beam gap between the end of the first beam and the end of the second beam.

As a preferred technical scheme of any one of the above schemes, two comb plates each having a plurality of comb teeth are respectively mounted on one mounting recess, the plurality of comb teeth of the two comb plates are defined as the plurality of expansion and contraction members. The expansion and contraction member may also not be comb plates each having the plurality of comb teeth, and directly uses square steel plate.

Compared with the prior art, the jointless bridge expansion and contraction device of the present invention has the following advantages. The plurality of supporting blocks, the plurality of expansion and contraction members and the plurality of spring draw rods in the jointless bridge expansion and contraction device are buried in the elastic filling layer. The elastic material layer has advantages of good sealing performance and water resistance, and resistance to acid and alkali corrosion. After cooling and setting, the elastic material layer becomes a filler layer structure with elasticity. Compared with the conventional expansion and contraction devices, this expansion and contraction device has higher construction efficiency, simple overall structure, fast construction speed and less impact on traffic. In addition, this expansion and contraction device can satisfy the elasticity and deformation in longitudinal, transverse and vertical directions of curved, slope and skew bridges, and is suitable for bridges with large scale displacement and large traffic flow.

DETAILED DESCRIPTION OF THE INVENTION

The present invention will be further described below in detail by embodiments with reference to the accompanying drawings.

Embodiment 1

Figure 1:
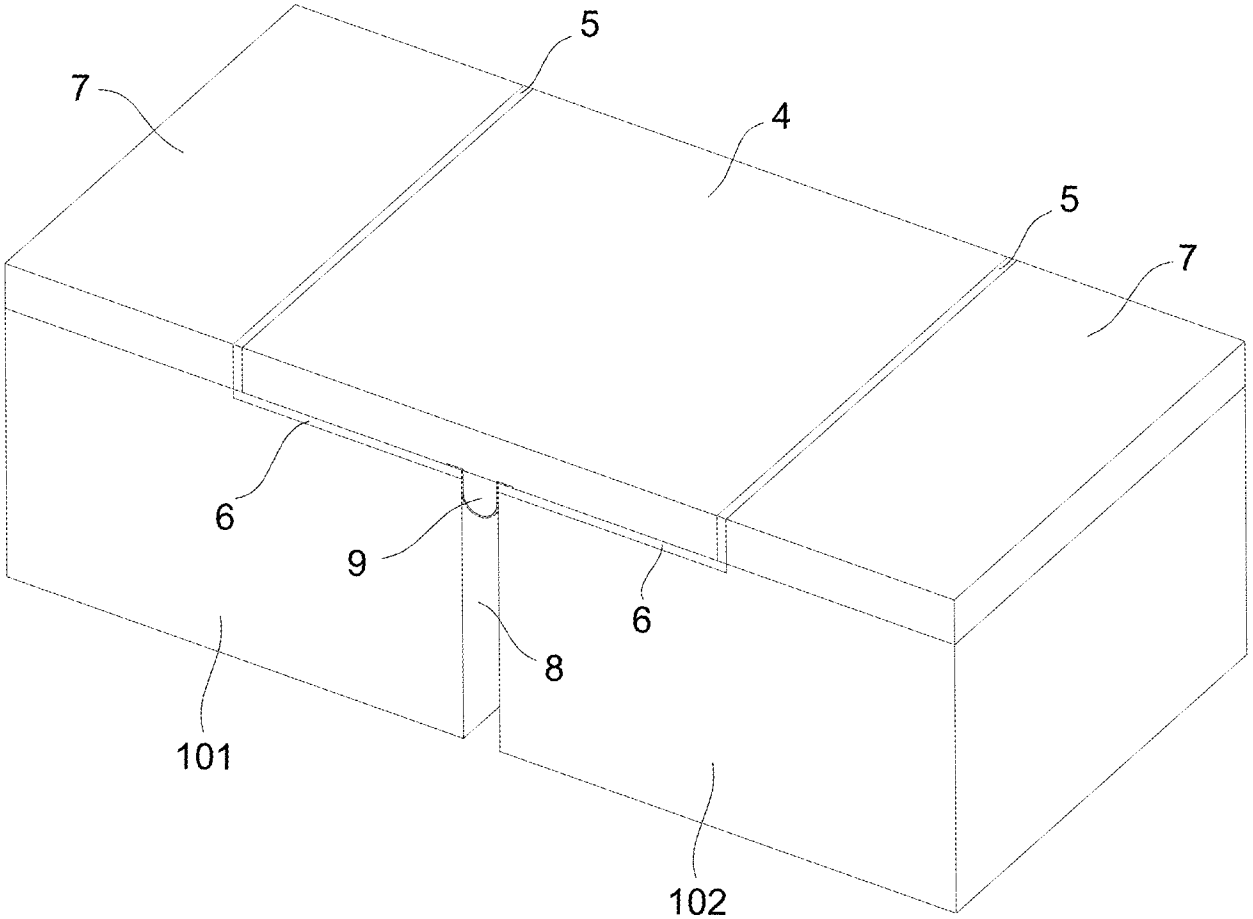
FIG. 1 is a perspective view of a jointless bridge expansion and contraction device according to an embodiment of the present invention.
Figure 2:
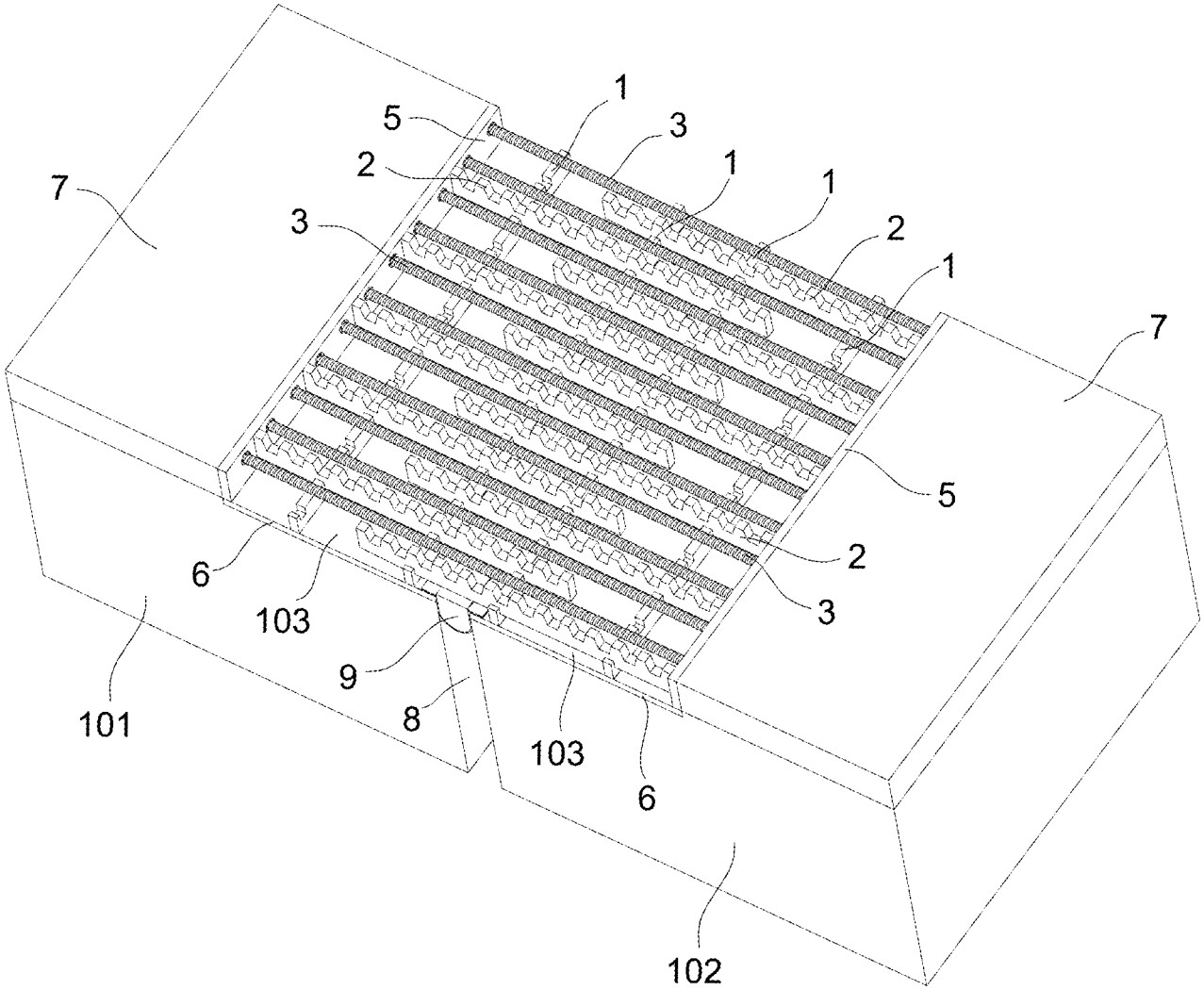
FIG. 2 is another perspective view of the jointless bridge expansion and contraction device in FIG. 1 showing an internal configuration of the device.
Figure 3:
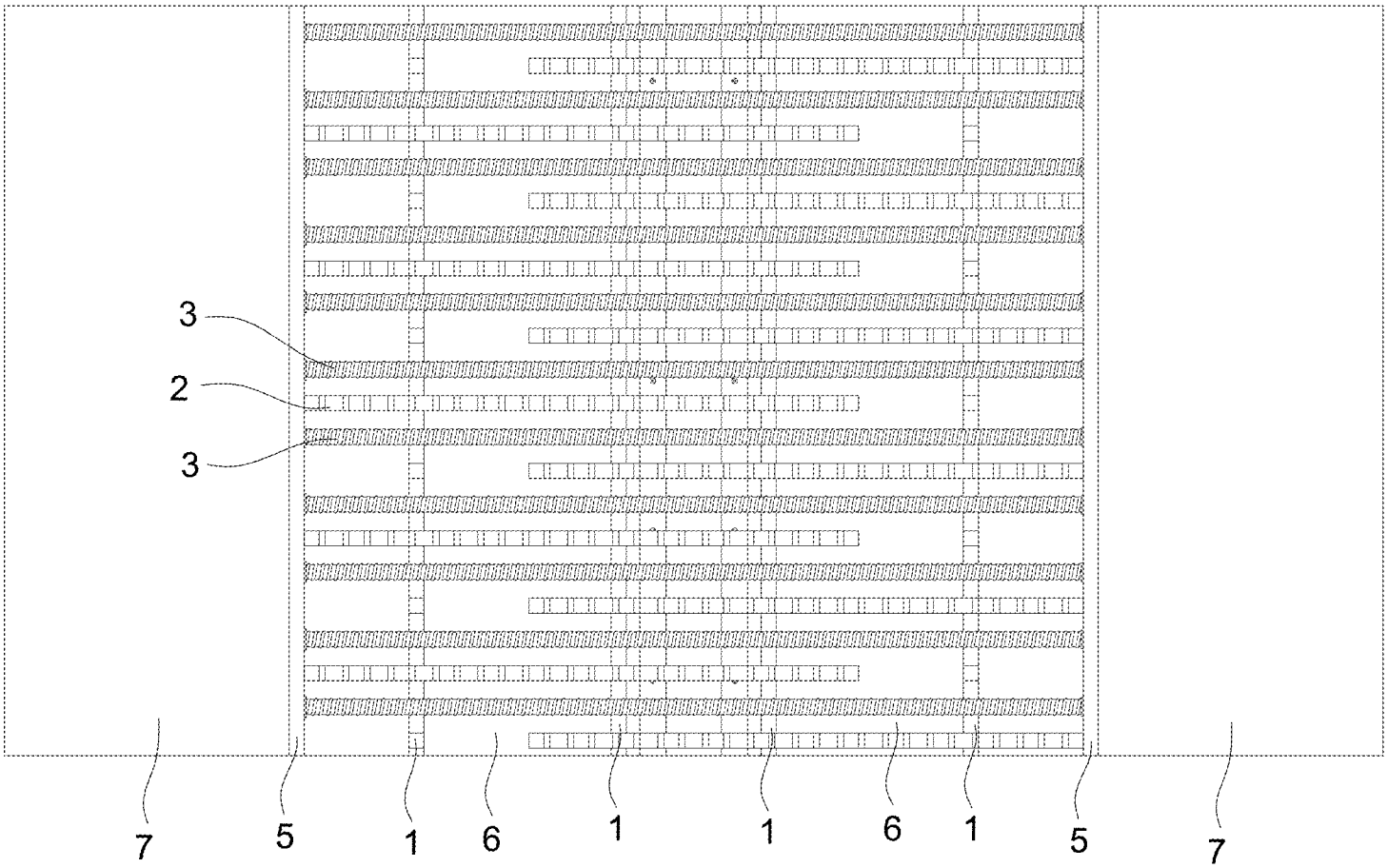
FIG. 3 is a top view of the jointless bridge expansion and contraction device in FIG. 1.
Figure 4:
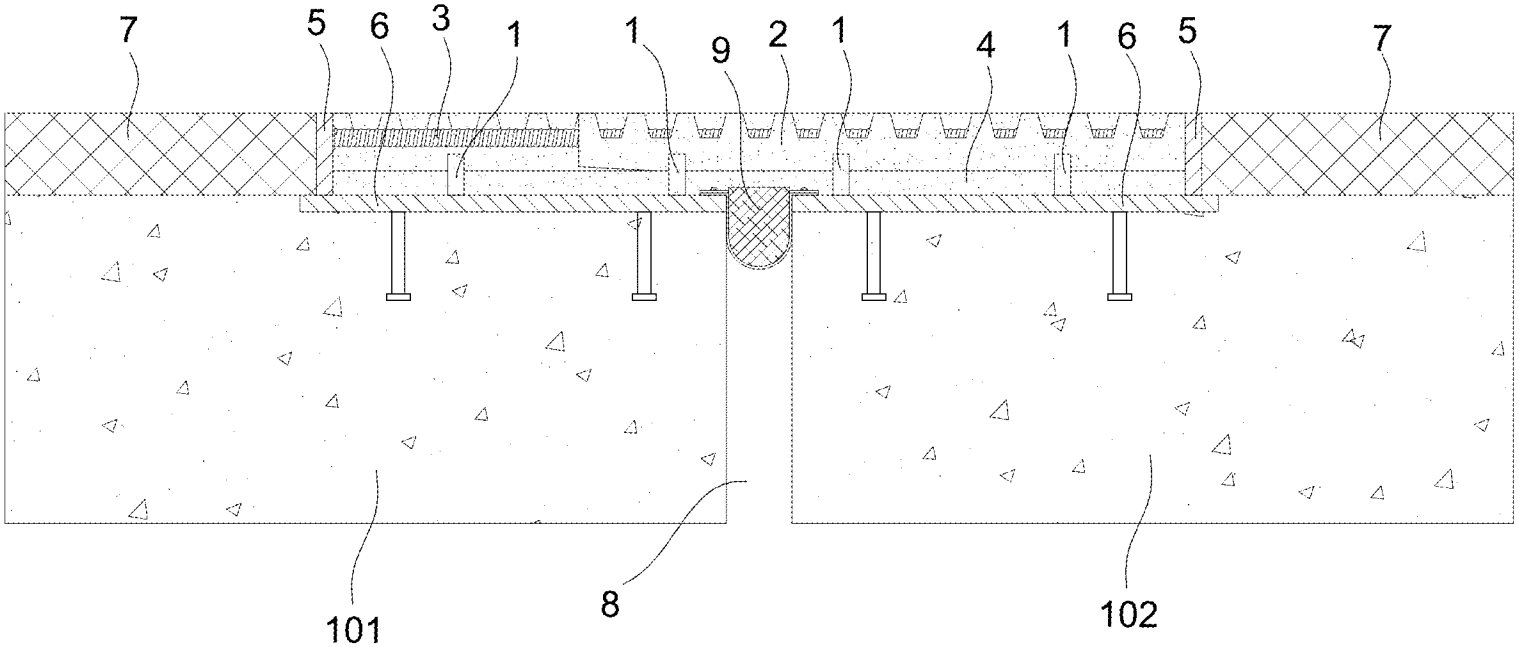
FIG. 4 is a sectional view of a part of the jointless bridge expansion and contraction device in FIG. 1.
Figure 5:
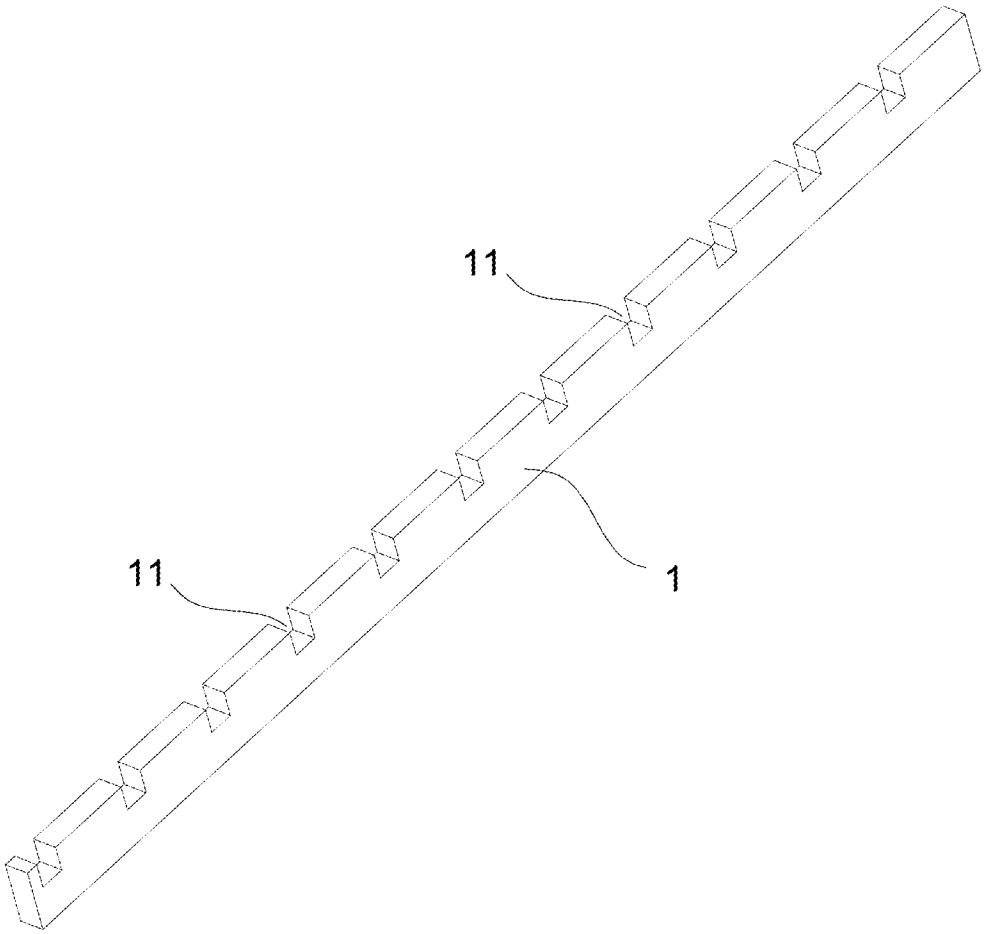
FIG. 5 is a perspective view of a supporting block according to the embodiment of the present invention.

FIGS. 1-5 show a preferred embodiment of a jointless bridge expansion and contraction device of the present invention. The bridge has a first beam and a second beam, the jointless bridge expansion and contraction device spans between an end 101 of the first beam and an end 102 of the second beam. Each of the end 101 of the first beam and the end 102 of the second beam has a mounting recess 103. The two opposite mounting recesses 103 are used for mounting the jointless bridge expansion and contraction device. The jointless bridge expansion and contraction device comprises a plurality of supporting blocks 1, a plurality of expansion and contraction members 2, a plurality of spring draw rods 3, an elastic filling layer 4, two anti-crash baffles 5, two pre-buried steel plates 6 and other main assemblies.

The pre-buried steel plate 6 is mounted beneath each of the mounting recesses 103 of the end 101 of the first beam and the end 102 of the second beam, the plurality of supporting blocks 1 is disposed inside the mounting recess 103. Each supporting block 1 is strip-shaped and arranged widthwise of the bridge, and the plurality of supporting blocks 1 is connected to the pre-buried steel plate 6. In this embodiment, two supporting blocks 1 are arranged in each of the mounting recesses 103 of the end 101 of the first beam and the end 102 of the second beam, respectively. Each supporting block 1 has a plurality of guide grooves 11 at a top of the supporting block 1, and the plurality of guide grooves 11 is arranged at regular intervals in a length direction of the supporting block 1.

In this embodiment, two comb plates each having a plurality of comb teeth are respectively mounted on one mounting recess 103, the plurality of comb teeth of the two comb plates are defined as the plurality of expansion and contraction members 2. The plurality of comb plates is arranged on the supporting blocks 1 and distributed at regular intervals widthwise of the bridge, and each comb plate is positioned in the guide grooves 11 which are used for guiding a sliding direction of the comb plates.

Two anti-crash baffles 5 located in the mounting recess 103 are respectively connected to the end 101 of the first beam and the end 102 of the second beam. The root end of each expansion and contraction member 2 is connected to the anti-crash baffle 5 on the corresponding mounting recess 103. The plurality of spring draw rods 3 with two ends is disposed on the plurality of supporting blocks 1 and distributed at intervals along the width of the bridge, two ends of each spring draw rod 3 are respectively connected to the anti-crash baffles 5 of the end 101 of the first beam and the end 102 of the second beam. In this embodiment, the plurality of expansion and contraction members 2 and the plurality of spring draw rods 3 are distributed alternatively and at regular intervals along the width of the bridge.

The mounting recess 103 of each of the end 101 of the first beam and the end 102 of the second beam is filled with an elastic filling layer 4, and the plurality of supporting blocks 1, the plurality of expansion and contraction members 2 and the plurality of spring draw rods 3 are buried in the elastic filling layer 4. The elastic filling layer 4 may be of a layer structure filled with an elastic material, for example, polyurethane elastic gum or bituminous grout; or, this material as a main base material is mixed with other materials to obtain a joint filling material, and the joint filling material is then filled into a region surrounded by two anti-crash baffles 5 to wrap the plurality of comb plates and the plurality of spring draw rods 3, and then cooled to obtain an elastic filler layer structure. The elastic material has the following properties: a. a bonding strength with steel and concrete is 6 MPa; b. an elongation at break of the material is greater than 50%; and, c. a tensile strength of the material is 15 MPa.

In order to improve a driving stability, a top surface of the elastic filling layer 4 is flush with a top surface of the anti-crash baffles 5. In addition, a bridge floor pavement layer 7 is paved on the mounting recess 103 at a side of each anti-crash baffle 5 away from the plurality of expansion and contraction members 2 and a top surface of each bridge floor pavement layer 7 is flush with the top surface of each anti-crash baffle 5.

In this embodiment, a filler 9 is mounted in a beam gap 8 between the end 101 of the first beam and the end 102 of the second beam to avoid a leakage of the elastic material during pouring.

The process of mounting the jointless bridge expansion and contraction device is as follows:

S1: the pre-buried steel plate 6 is mounted at the end 101 of the first beam and the end 102 of the second beam during beam construction;

S2: the filler 9 is mounted in the beam gap 8;

S3: the anti-crash baffles 5 and the supporting blocks 1 are mounted;

S4: the comb plates and the spring draw rods 3 are mounted;

S5: the elastic filling layer 4 is poured;

S6: Rolling is performed.

The protection scope of the present invention is not limited to each embodiment described in this description. Any changes and improvements made on the basis of the scope of the present invention patent and of the description, for example, the expansion and contraction member may also use square steel plates or other types instead of the comb plates, shall be included in the scope of the present invention patent.

The invention claimed is:

1. A jointless bridge expansion and contraction device, the bridge having a first beam and a second beam, the jointless bridge expansion and contraction device disposed between an end (101) of the first beam and an end (102) of the second beam, comprising:

a plurality of supporting blocks (1) each arranged widthwise of the bridge;

a plurality of expansion and contraction members (2) each having a root end;

a plurality of spring draw rods (3) each having two ends; wherein, each of the end (101) of the first beam and the end (102) of the second beam has a mounting recess (103) to mount the plurality of supporting blocks (1);

each expansion and contraction member (2) is disposed on the plurality of supporting blocks (1) and distributed at intervals along the width of the bridge, the root end of each expansion and contraction member (2) is connected to the end (101) of the first beam or the end (102) of the second beam adjacent to the root end of the expansion and contraction member (2);

the plurality of spring draw rods (3) with two ends is disposed on the plurality of supporting blocks (1) distributed at intervals along the width of the bridge, two ends of each spring draw rod (3) are respectively connected to the end (101) of the first beam and the end (102) of the second beam;

the mounting recess (103) of each of the end (101) of the first beam and the end (102) of the second beam is filled with an elastic filling layer (4), and the plurality of supporting blocks (1), the plurality of expansion and contraction members (2) and the plurality of spring draw rods (3) are buried in the elastic filling layer (4); and two anti-crash baffles (5) located in the mounting recess (103) are respectively connected to the end (101) of the first beam and the end (102) of the second beam;

the two ends of each spring draw rod (3) are connected to the anti-crash baffle (5) on the corresponding mounting recess (103), the root end of each expansion and contraction member (2) is connected to the anti-crash baffle (5) on the corresponding mounting recess (103).

2. The device of claim 1, wherein a top surface of the elastic filling layer (4) is flush with a top surface of the anti-crash baffles (5).

3. The device of claim 2, wherein a bridge floor pavement layer (7) is paved on the mounting recess (103) at a side of each anti-crash baffle (5) away from the plurality of expansion and contraction members (2) and a top surface of each bridge floor pavement layer (7) is flush with the top surface of each anti-crash baffle (5).

4. The device of claim 1, wherein a pre-buried steel plate (6) is mounted beneath each mounting recess (103), the plurality of supporting blocks (1) is connected to the pre-buried steel plate (6).

5. The device of claim 1, wherein the plurality of expansion and contraction members (2) and the plurality of spring draw rods (3) are distributed alternatively and at regular intervals along the width of the bridge.

6. The device of claim 1, wherein each supporting block (1) has a plurality of guide grooves (11) at a top of each supporting block (1), each expansion and contraction member (2) is positioned inside the corresponding guide groove (11).

7. The device of claim 1, wherein a filler (9) is mounted in a beam gap (8) between the end (101) of the first beam and the end (102) of the second beam.

8. The device of claim 1, wherein two comb plates each having a plurality of comb teeth are respectively mounted on one mounting recess (103), the plurality of comb teeth of the two comb plates are defined as the plurality of expansion and contraction members (2).

* * * * *